US006602581B2

(12) United States Patent
Aneja

(10) Patent No.: US 6,602,581 B2
(45) Date of Patent: Aug. 5, 2003

(54) CORRUGATED FIBERFILL STRUCTURES FOR FILLING AND INSULATION

(75) Inventor: Arun Pal Aneja, Greenville, NC (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 27 days.

(21) Appl. No.: 10/020,564

(22) Filed: Dec. 12, 2001

(65) Prior Publication Data

US 2003/0118785 A1 Jun. 26, 2003

(51) Int. Cl.[7] ..... B32B 3/28; B31F 1/22; A47C 20/02

(52) U.S. Cl. ..... 428/182; 428/175; 428/176; 428/181; 156/62.2; 156/205; 156/210; 5/636

(58) Field of Search ..... 428/175, 176, 428/181, 182; 19/163; 156/62.6, 62.2, 205, 210; 28/159, 162; 5/636

(56) References Cited

U.S. PATENT DOCUMENTS

| | | | | |
|---|---|---|---|---|
| 2,689,811 A | | 9/1954 | Frederick et al. | |
| 4,576,853 A | * | 3/1986 | Vaughn et al. | 428/181 |
| 4,618,531 A | | 10/1986 | Marcus | |
| 5,057,168 A | * | 10/1991 | Muncrief | 156/62.6 |
| 5,112,684 A | | 5/1992 | Halm et al. | |
| 5,558,924 A | | 9/1996 | Chien et al. | |
| 5,702,801 A | | 12/1997 | Chien | |
| 5,723,215 A | | 3/1998 | Hernandez et al. | |

FOREIGN PATENT DOCUMENTS

| | | |
|---|---|---|
| EP | 0648877 B1 | 8/1994 |
| WO | WO 9961693 A1 | 12/1999 |

* cited by examiner

*Primary Examiner*—Donald J. Loney

(57) ABSTRACT

This invention provides corrugated fiberfill structures with improved properties and processes for making the same. This invention further provides articles made from the improved corrugated fiberfill structures of the present invention.

11 Claims, 8 Drawing Sheets

100

CORRUGATED FIBERFILL STRUCTURES FOR FILLING AND INSULATION

TECHNICAL FIELD AND INDUSTRIAL APPLICABILITY OF INVENTION

The present invention relates to improvements in polyester fiberfill structures and articles made therefrom. Further, the invention relates to improved processes for making polyester fiberfill structures and articles from such structures. These articles are suitable for both domestic and industrial end use, such as pillows, sleeping bags, car seats, insulation, quilts, apparel, filters and the like.

BACKGROUND OF THE INVENTION

Polyester fiberfill is used commercially in many garments and other articles because of its desirable thermal insulating and aesthetic properties. Polyester fiberfill is generally used commercially in garments in the form of bulky quilted batts (sometimes referred to as batting). Most commercial polyester fiberfill has been in the form of crimped polyester staple fiber. Another commercial use for polyester fiberfill is in the form of a corrugated fibrous batting/structure.

A known process and apparatus used for consolidation of bulky fibrous webs into a corrugated structure is disclosed in Krema et. al., EP-0-648-877-B1. This document does not disclose any desired properties of the corrugated structure to be obtained or any products to be made from the structure formed. Similarly, a device for forming sheets of fibrous web, where the web is vertically folded, is disclosed in International Application No. WO/99/61693 by Jirsak et al. Jirsak et. al., like Krema et al., does not disclose any desired properties of the fibrous batting to be obtained or any products to be made from the structure formed.

Frederick et al., U.S. Pat. No. 2,689,811 also discloses a method of making corrugated fibrous battings. However, although Frederick states that its corrugated battings are of loose construction and have very low bulk density, this document also does not teach or suggest any desired properties of the corrugated structure to be obtained or any products to be made from the structure formed.

Other attempts at producing variable density, corrugated resin-bonded or thermo-bonded fiberfill structures are disclosed in Chien, U.S. Pat. No. 5,702,801 and Chien et al., U.S. Pat. No. 5,558,924. Chien '801 discloses a method of corrugating bonded polyester fiberfill that enhances the final product's three-dimensional strength and resilience with respect to other methods. The fiberfill is stated as being used for products such as quilts, pillows, cushion seats and sleeping bags. The fibrous webs are folded to form a plurality of pleats having alternating crests and bases. However, since the carded fibrous webs used in Chien are cross-lapped (25 layers) before being corrugated in a stuffer box type crimper mechanism, the resulting bulk density of the structure formed is very high, i.e. 15–25 kg/m$^3$, resulting in a very hard and undesirable quality of the material for some enduse applications.

Chien et al. '924 discloses a method of forming a corrugated structure from a fibrous web that results from a stuffer box type crimper mechanism. This structure from the stuffer box is stated as being used for products such as quilts, pillows, cushion seats, or sleeping bags. However, the process used in this document also uses carded fibrous webs which are cross-lapped before being corrugated in a stuffer box type crimper mechanism, resulting in limited properties of the structure formed, such as the height of the product produced being limited to between 1.95 inches (49.5 mm) and 2.11 inches (53.6 mm), due to the high bulk density of the product.

Therefore, there is a need for providing polyester fiberfill corrugated structures having desired performance for use, for example, in pillows, and methods of making such structures. Such performance is indicated by characteristics including loft/bulk, comfort, softness, durability and insulation.

SUMMARY OF THE INVENTION

The present invention solves the problems associated with the prior art by providing articles which have desired performance with respect to loft/bulk, comfort, resiliency, softness, durability and insulation. Applicant has found that such performance is achieved by a combination of certain structure bulk density, height and peak frequency. Moreover, Applicant has found that such performance is achieved when such structures are made from fibers with certain denier per filament, crimps per inch and crimp take-up. Applicant has measured performance in pillows in terms of three variables, namely, energy required for compression, WC, linearity of the resulting product, LC, and resiliency of the resulting product, RC.

Therefore, in accordance with the present invention there is provided a corrugated fiberfill structure having a configuration of essentially lengthwise rectangular cross section, with continuous parallel alternating peaks and valleys of approximately equal spacing, and a plurality of vertically aligned pleats which extend between each peak and each valley, the structure having a bulk density of about 5 to about 18 kg/m$^3$, a height of about 10 mm to about 50 mm and a peak frequency which occurs at about 4 to about 15 times per inch (1.58–5.91 times per cm). The fiberfill of this corrugated structure comprises fibers with a denier per filament of about 0.5 to about 30 (0.55–33 decitex per filament), crimps per inch of about 4 to about 15 (1.58–5.91 crimps per cm), and a crimp take-up of about 29% to about 40%. There is also provided a pillow having a corrugated structure having this bulk density, height and peak frequency, and made from a fiber having this denier per filament, crimps per inch and crimp take-up. This pillow has an energy for compression in the range of 0.253–0.584 lb/in$^2$×in/in (17.79–41.06 gm/cm$^2$×cm/cm ), linearity in the range of 0.480–0.678 and a resiliency in the range of 0.448–0.639.

Further in accordance with the present invention, there is provided a process for forming a corrugated fiberfill structure comprising feeding clumps of fiber stock from a bale comprising fiberfill material and a binder fiber to a picker where the fiberfill material and the binder fiber are opened up; feeding the opened up fiberfill material and the binder fiber to a blender to obtain a uniform mixture; carding the blend to form a fibrous web; vertically folding the fibrous web to form a closely packed, corrugated fiberfill structure having a configuration of essentially lengthwise rectangular cross-section having continuous alternating peaks and valleys of approximately equal spacing, and a plurality of vertically aligned pleats which extend between each peak and valley; heating the corrugated fiberfill structure to bond the binder fibers and the fiberfill material so that the structure is consolidated and maintains its corrugations, wherein the structure has a bulk density of about 5 to about 18 kg/m$^3$, a height of about 10 mm to about 50 mm and a peak frequency which occurs at about 4 to about 15 times per inch (1.58–5.91 times per cm).

DETAILED DESCRIPTION OF A PREFERRED EMBODIMENT OF THE INVENTION

With reference to the drawings (FIGS. 1 through 9), which illustrate preferred embodiments of the present invention, but are not intended to limit the same, the present invention provides new fiberfill structures, pillows made from such structures, and a process for making these structures.

Figure 1:
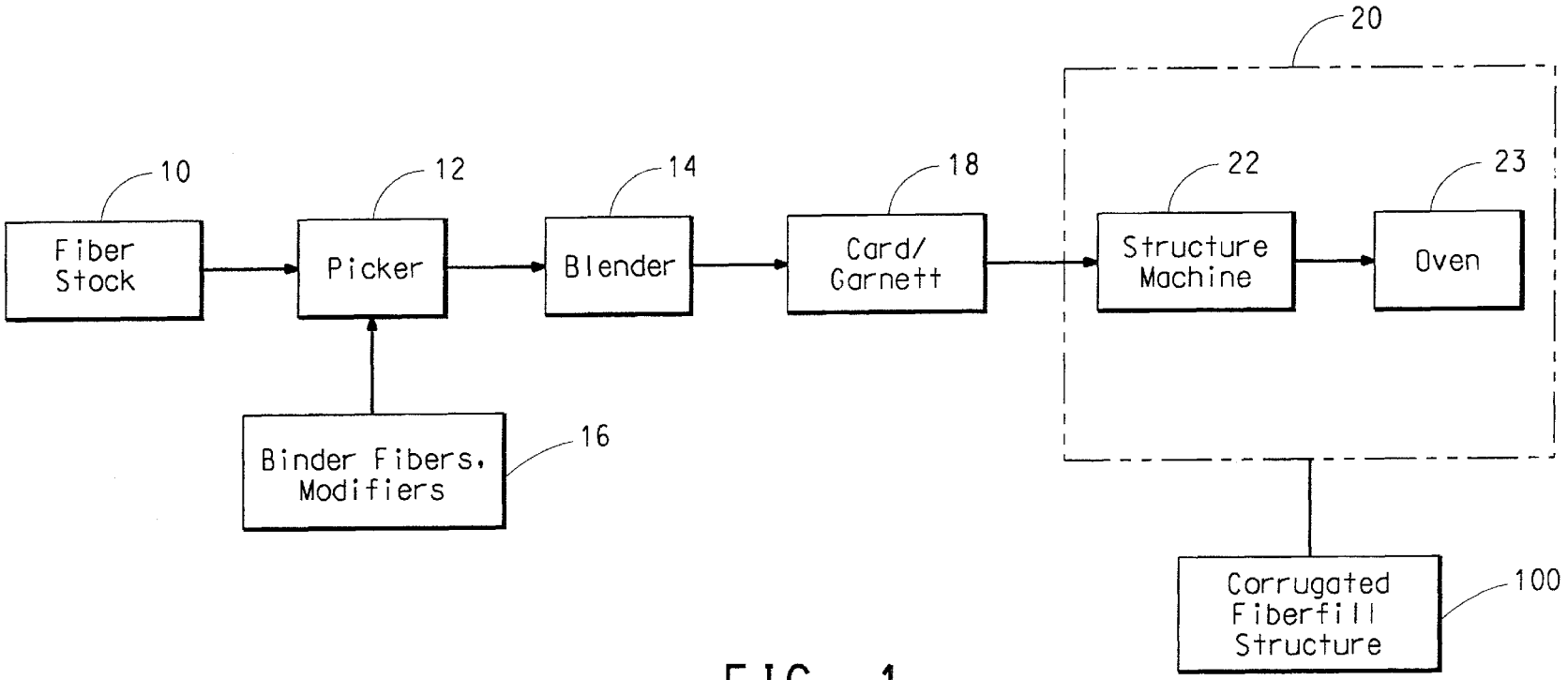
FIG. 1 is a block diagram illustrating the process for making new corrugated fiberfill structures of the present invention.

Now referring to FIG. 1, a preferred embodiment of a process for forming a corrugated fiberfill structure is illustrated. The process illustrated in FIG. 1 for making corrugated fibrous structures includes several steps. First, a fiber stock comprising fiberfill material contained in a bale in raw form is presented. The fiber stock is shown at 10 in FIG. 1. This bale is a tightly packed mass of staple fiber, weighing, for example, approximately 500 pounds (227 Kg).

Properties of the individual fibers (before being formed into structures) desirable to manufacture the final corrugated fiberfill structure of the present invention include denier per filament, crimp frequency, and crimp take-up. Denier is defined as the weight in grams of 9000 meters of fiber and is thus a measure in effect of the thickness of the fiber which makes up the structure. Crimp of a fiber is exhibited by numerous peaks and valleys in the fiber. Crimp frequency is measured as the number of crimps per inch (cpi) or crimps per centimeter (cpcm) after the crimping of a tow. It has been found, through extensive testing, that fibers having a denier per filament of about 0.5 to about 30 (0.55–33 decitex per filament), crimps per inch of about 4 to about 15 (1.58–5.91 crimps per cm), and a crimp take-up of about 29% to about 40% are particularly useful for the corrugated fiberfill structure of the present invention.

A known mechanical crimping process, which produces fibers crimped in two dimensions, may be used to crimp the staple fibers to produce the desired texture and number of crimps per inch, as discussed below. A detailed description of mechanically crimped fibers can be found in U.S. Pat. No. 5,112,684 to Halm et al. The use of three-dimensionally crimped staple fibers instead of two-dimensionally crimped staple fibers is also well known in the art. There are several methods for imparting a three-dimensional crimp, including the technologies of asymmetrically quenching, bulk continuous filament (BCF) processing, conjugate spinning of two polymers differing only in molecular chain length, and bicomponent spinning of two different polymers or copolymers, such as, that disclosed in U.S. Pat. No. 5,723,215 and in U.S. Pat. No. 4,618,531 to Marcus. Relative to the two-dimensional mechanically crimped fibers, three-dimensional crimped staple fibers and articles produced therefrom are known to offer distinct advantages such as higher loft, softness, improved crimp recovery, shelf appeal, and better compactability. However, both crimped fibers obtained from mechanical crimping and three-dimensional crimping technologies may be used in making the new polyester fiberfill structures of the present invention.

Fibers from a wide variety of both addition and condensation polymers can be used to form the corrugated fiberfill structures of the present invention. Typical of such polymers are: polyhydrocarbons such as polyethylene, polypropylene and polystyrene; polyethers such as polyformaldehyde; vinyl polymers such as polyvinyl chloride and polyvinylidene fluoride; polyamides such as polycaprolactam and polyhexamethylene adipamide; polyurethanes such as the polymer from ethylene bischloroformate and ethylene diamine; polyesters such as polyhydroxypivalic acid and poly(ethylene terephthalate); copolymers such as poly (ethylene terephthalate-isophthalate) and their equivalents.

Preferred materials are polyesters, including poly (ethylene terephthalate), poly(propylene terephthalate), poly (butylene terephthalate), poly(1,4-cyclohexylene-dimethylene terephthalate) and copolymers thereof. Most or all of the polymers useful as fiber materials according to the present invention can be derived from recycled materials. The fiberfill can be formed from any desired polyester, such as, for example, homopolymers, copolymers, terpolymers, and melts blends of monomers made from synthetic, thermoplastic polymers, which are melt-spinnable.

Alternatively, the fiberfill can be formed from para-aramids, which are used to make aramid fibers sold under the trademark KEVLAR® by E. I. du Pont de Nemours and Company of Wilmington, Delaware (hereinafter "DuPont"), or meta-aramids, which are used to make aramid fibers sold under the trademark NOMEX® by DuPont.

Clumps of the fiber stock are removed one after another and then fed to a picker, which is shown at 12 in FIG. 1. At the picker, the fiberfill is opened up. A binder fiber is also sent to the picker as shown at in FIG. 1, and the binder fiber is also opened up at the picker. Binder fibers of many different materials can be used, however, the preferred binder used is MELTY 4080 (commercially available from Unitika Co., Japan), which has a core of polyester homopolymer and a sheath of copolyester. Binder fibers are especially useful for improving the stability, dimensional and handling characteristics of the fiberfill structure of the present invention, once it is formed. For example, if the blend of fiberfill fibers and binder fibers is heated, during the heating step, the binder fibers melt and bond the fiberfill fibers such that the corrugated structure of the present invention retains its desired configuration, i.e., specific height, peak frequency and bulk density, as will be discussed below. A modifier such as an antimicrobial may also be used in addition to the binder fibers. It is also within the scope of the present invention to use a pre-blended fiber stock which already includes binder fibers, thereby eliminating the need for mixing the binder fibers in the picker.

The process of the invention further comprises feeding the opened up fiberfill and the opened up binder fiber to a blender, such as blender 14 as shown in FIG. 1, to form a uniform mixture. The process of the present invention further comprises carding the blend to form a fibrous web. This carding is performed by a card/garnet as shown at 18 in FIG. 1 in order to form a fibrous web. The fibers of the web are parallel aligned in the machine direction. The fibrous web is then sent, via a conveyer (not shown), into an Engineered Structure with Precision (ESP) machine 22 and an oven 23, the combination being shown generally at 20 in FIG. 1. Machine 22 is known in the art, as disclosed in WO 99/61693, and is shown in FIGS. 2A and 2B herein.

Figure 2A:
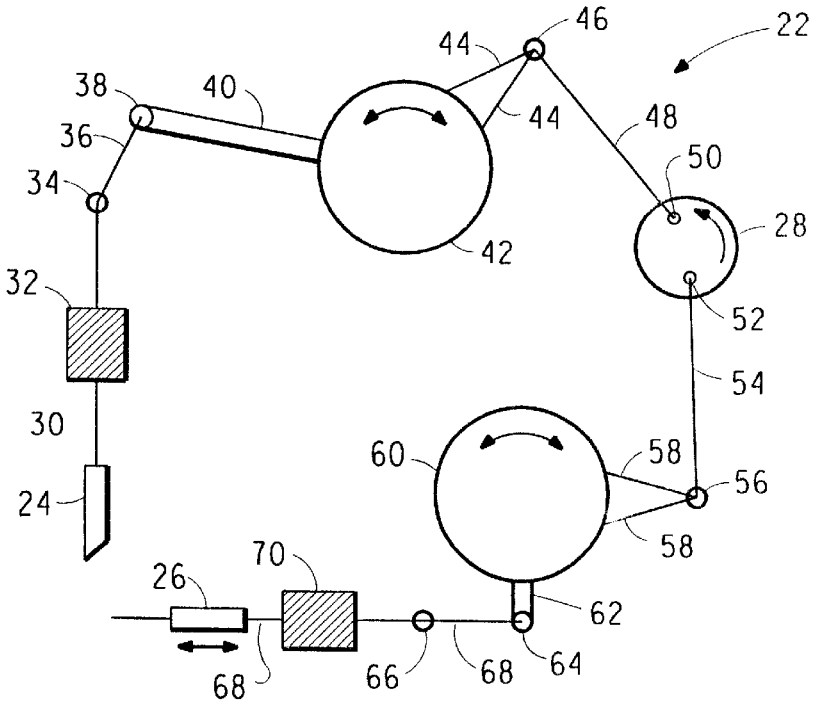
FIG. 2A (PRIOR ART)
FIG. 2A is a schematic view of a machine of the prior art which has two reciprocating elements which may be used with the process of the present invention for manufacturing the desired corrugated fiberfill structures of the present invention.

As shown in FIG. 2A, machine 22 includes two synchronously reciprocating elements 24 and 26 connected to a driving mechanism 28. A tie rod 30 connects element 24 to a sliding fitting 32 and also connects sliding element 32 to a flexible knuckle joint 34. Sliding fitting 32 keeps tie rod 30 in its vertical position. A bolt 38 connects tie rod 36 to an arm 40, which in turn is connected to a shaft 42. It is shaft 42 which imparts a vertical reciprocating motion to reciprocating element 24. A pair of tie rods 44 connect shaft 42 to driving mechanism 28 via a bolt 46 and a tie rod 48. Tie rod 48 is connected to driving mechanism 28 by a bolt, and a tie rod 54 is connected to driving mechanism 28 by a bolt 52. A bolt 56 connects tie rod 54 to a pair of tie rods 58, which connect to a shaft 60. Shaft 60 imparts horizontal reciprocating motion to reciprocating element 26. Shaft 60 connects to an arm 62, which is connected via flexible knuckle joints 64 and 66 and a tie rod 68 to a sliding fitting 70. The sliding fitting keeps the tie rod in its horizontal position.

Figure 2B:
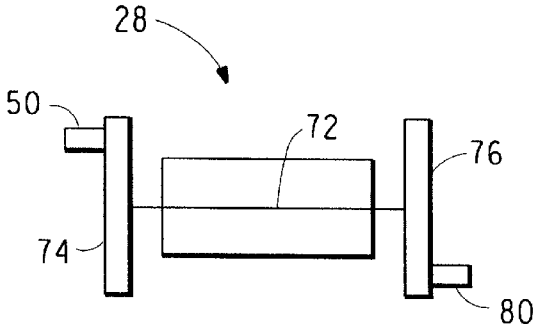
FIG. 2B (PRIOR ART)
FIG. 2B is a schematic view of the driving mechanism for the two reciprocating elements of the machine of the prior art shown in FIG. 2A.
Figure 3:
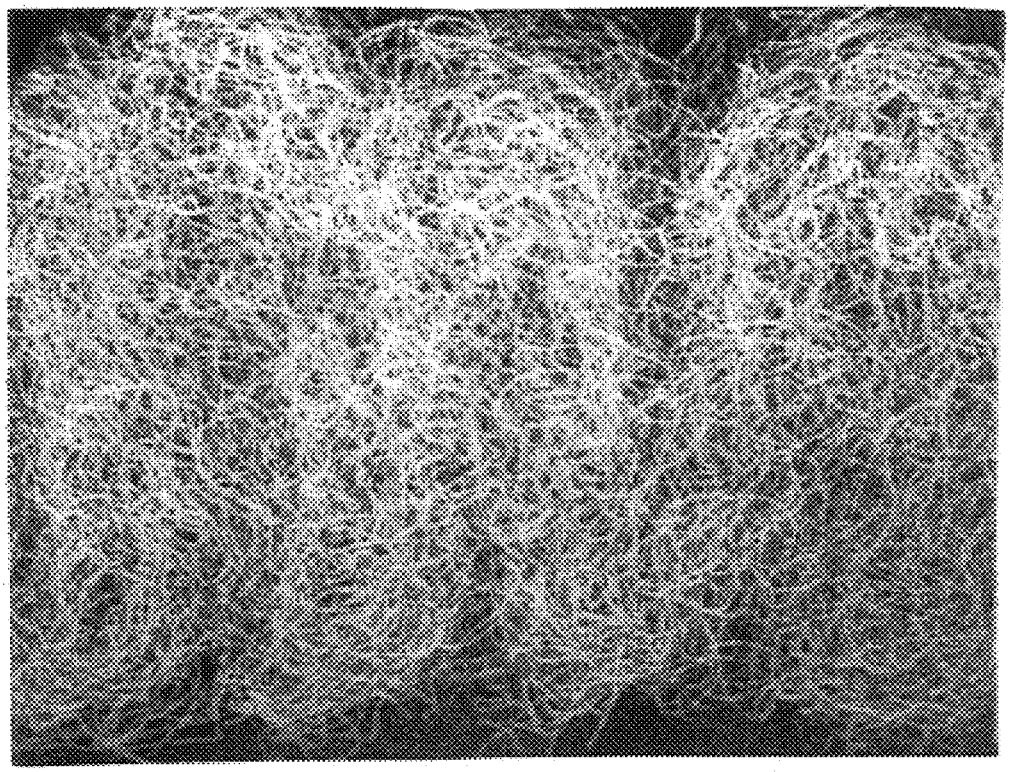
FIG. 3 is a photographic representation of the corrugated fiberfill structure of the present invention.

As shown in FIG. 2B, driving mechanism 28 includes a driving shaft 72 with two cam rolls 74 and 76. Driving mechanism 28 reciprocates element 24 vertically and element 26 horizontally. The cam rolls allow synchronized phase movement of the reciprocating elements. Element 24 is reciprocated perpendicular to the lengthwise direction of the fibrous web, and element 26 is reciprocated parallel to the lengthwise direction of the fibrous web. These reciprocating motions thereby vertically fold the web to form a closely packed, corrugated structure and simultaneously move it forward (i.e., horizontally in the process direction away from the fibrous web).

After the fiberfill structure is shaped into its desired form, it is passed immediately into an oven, such as oven 23 as shown in FIG. 1, where it is heated to bond and consolidate it so that it maintains its corrugations. As the structure exits the oven, it is in the form of a folded structure. The resulting corrugated fiberfill structure of the present invention is shown at 100 in FIGS. 1, 3 and 4A.

Figure 4A:
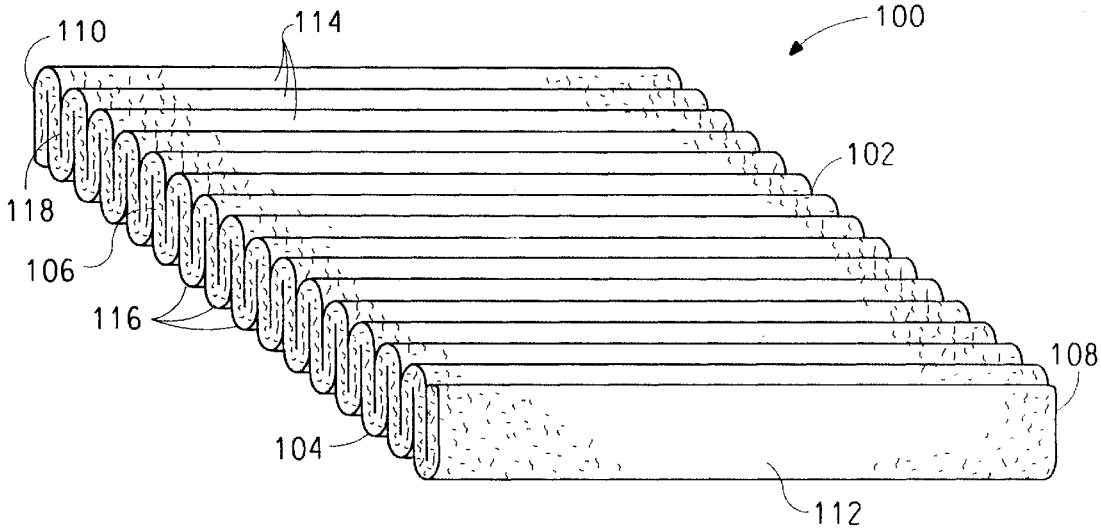
FIG. 4A is a perspective view of the corrugated fiberfill structure of the present invention.
Figure 4B:
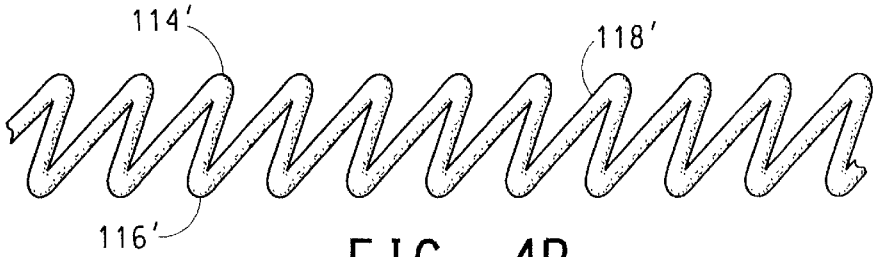
FIG. 4B is a cross-sectional view of an alternative embodiment of the corrugated fiberfill structure of the present invention.
Figure 4C:
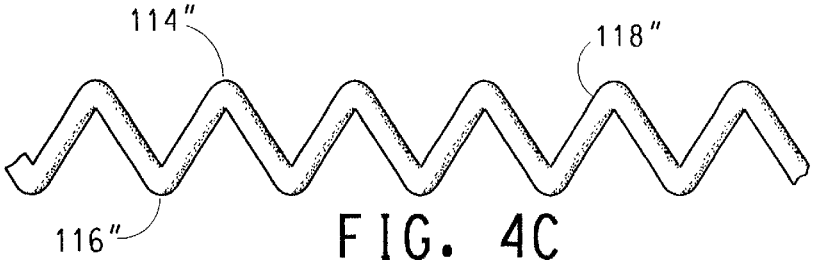
FIG. 4C is a cross-sectional view of a further alternative embodiment of the corrugated fiberfill structure of the present invention.
Figure 4D:
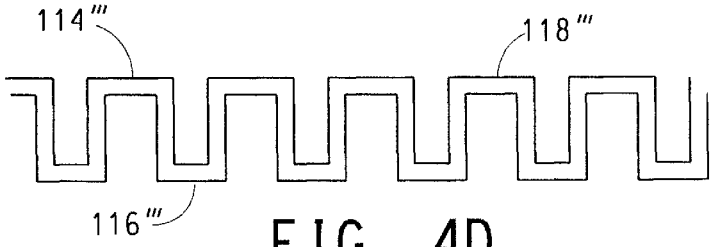
FIG. 4D is a cross-sectional view of another alternative embodiment of the corrugated fiberfill structure of the present invention.
Figure 5:
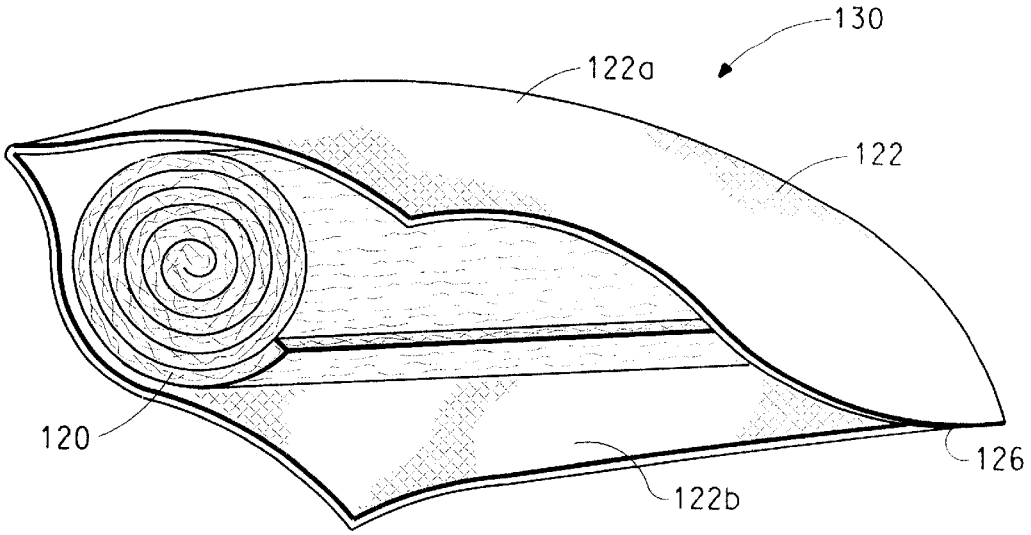
FIG. 5 is a perspective view of a pillow made with the corrugated structures of the present invention.

Various configurations of the corrugated fiberfill structure of the present invention are shown in FIGS. 4A–4D. As can be seen in from these FIGS., the corrugated fiberfill structure of the present invention has an essentially lengthwise rectangular cross section. The corrugated structure as shown in FIG. 4A has an upper surface 102 and a lower surface 104, a side wall 106 and a side wall 108, and end walls 110 and 112. As can be seen from FIGS. 4A–4D, the corrugated structure comprises a plurality of continuous alternating peaks and valleys of approximately equal spacing. The peaks and valleys are shown at 114, 114', 114" and 114'", and at 116, 116', 116" and 116'", respectively in FIGS. 4A–4D. In addition, the corrugated structure comprises a plurality of parallel, generally vertically aligned pleats, or corrugations, 118, 118', 118" and 118'" which are arranged in accordion-like fashion and which extend in alternately different directions between each peak and each valley. The upper surface of the structure is formed by the peaks, while the lower surface is formed by the valleys. The side walls 106, 108 are formed by the ends of the pleats, and the end walls 110 and 112 are formed by the last pleats of the structure. In the embodiments of FIGS. 4A–4C, the peaks and the valleys are generally rounded. The pleats of the corrugated structure can be saw-tooth, as shown in the embodiment of FIG. 4B, triangular shape, as shown in the embodiment of FIG. 4C, or square/rectangular shape, as shown in the embodiment of FIG. 4D. Moreover, the corrugation may be vertical as shown in FIGS. 4A, 4C and 4D, or inclined as shown in FIG. 4B.

Important features of the corrugated fiberfill structure of the present invention, which have been predetermined by extensive testing, are bulk density, height and peak frequency. Specifically, the corrugated fiberfill structure of the present invention should have a bulk density of about 5 to about 18, kg/m$^3$, a height of about 10 mm to about 50 mm, and a peak frequency which occurs at about 4 to about 15 times per inch (1.58–5.91 times per cm). The bulk density of the corrugated structure is controlled by fixing the throughput rate of the web and the output rate of the structure. The height of the corrugated structure is controlled by the thickness of the push bar (not shown) used for forcing the web away from reciprocating member 26 as shown in FIG. 2A and into the oven. Peak frequency is measured as the total number of peaks per inch (peaks per centimeter) of structure. For a given thickness of web, controlling the peak frequency is obtained by adjusting the speed of the reciprocating elements (i.e., the number of times per minute the reciprocating elements make contact with the fibrous web to form a crease (stratify)) and the speed of the conveyor belt which is used for moving the corrugated structure away from reciprocating member 24 in FIG. 2A.

Further in accordance with the process of the present invention, the corrugated fibrous structure may be rolled, and the rolled corrugated fiberfill structure is stuffed into a tick to form a pillow. This embodiment is shown with respect to FIG. 5, where the corrugated fiberfill structure is advantageously rolled upon itself to form it into a bun 120 of substantially cylindrical or elliptical configuration. The rolled-up bun is placed inside a pillow tick 122, which conveniently is formed of two sheets or panels 122*a*–122*b* of suitable ticking material such as cotton, silk, polyester, blended material or the like. Panels 122*a*–122*b* are stitched together along opposed margins 126 (only one being shown for each of the length and the width of the pillow in FIG. 5) after the bun has been positioned and enclosed in the tick by exerting a compressive force. The pillow, shown at 130 in FIG. 5, assumes the desired shape. The pillow of the present invention is made from a corrugated structure which has peaks that occur at about 4 to about 15 times per inch (1.58–5.91 times per cm), a bulk density of about 5 to about 18 kg/m$^3$ and a height of about 10 mm to about 50 mm. It is further desirable that the fibers of the corrugated structure have a denier per filament of about 0.5 to about 30 (0.55–33 decitex per filament), crimps per inch of about 4 to about 15 (1.58–5.91 crimps per cm) and a crimp take-up of about 29% to about 40%.

Figure 6:
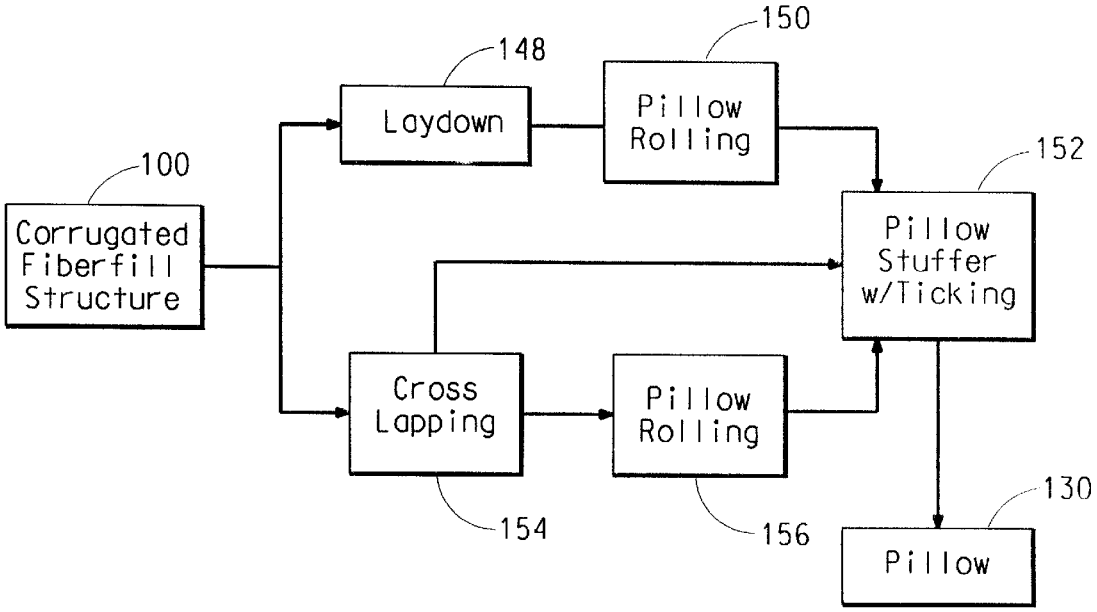
FIG. 6 is a block diagram of a process for folding the corrugated fiberfill structures of the present invention into an article, such as a pillow.

Two different processes for making a pillow with the structure of the present invention are illustrated in FIG. 6. Either the structure can be laid down as shown at 148 and then rolled into a pillow at 150, or more height can be built into the pillow by cross-lapping the structure to the height desired for the pillow as shown at 154 and then rolled into a pillow at 156. In either case, the pillow is sent to a stuffer where it is put into a ticking at 152 to form a pillow at 130.

The corrugated fiberfill structure of the present invention can also be used to make other articles, such as sleeping bags, cushion seats, insulated garments, filter media, etc. These articles have the desired characteristics obtained by determining the desired bulk density, height and peak frequency of corrugated structure used. For any article made with the corrugated structure of the present invention, either a single layer or plural layers of structure may be used, depending on the desired height of the final article.

Figure 7:
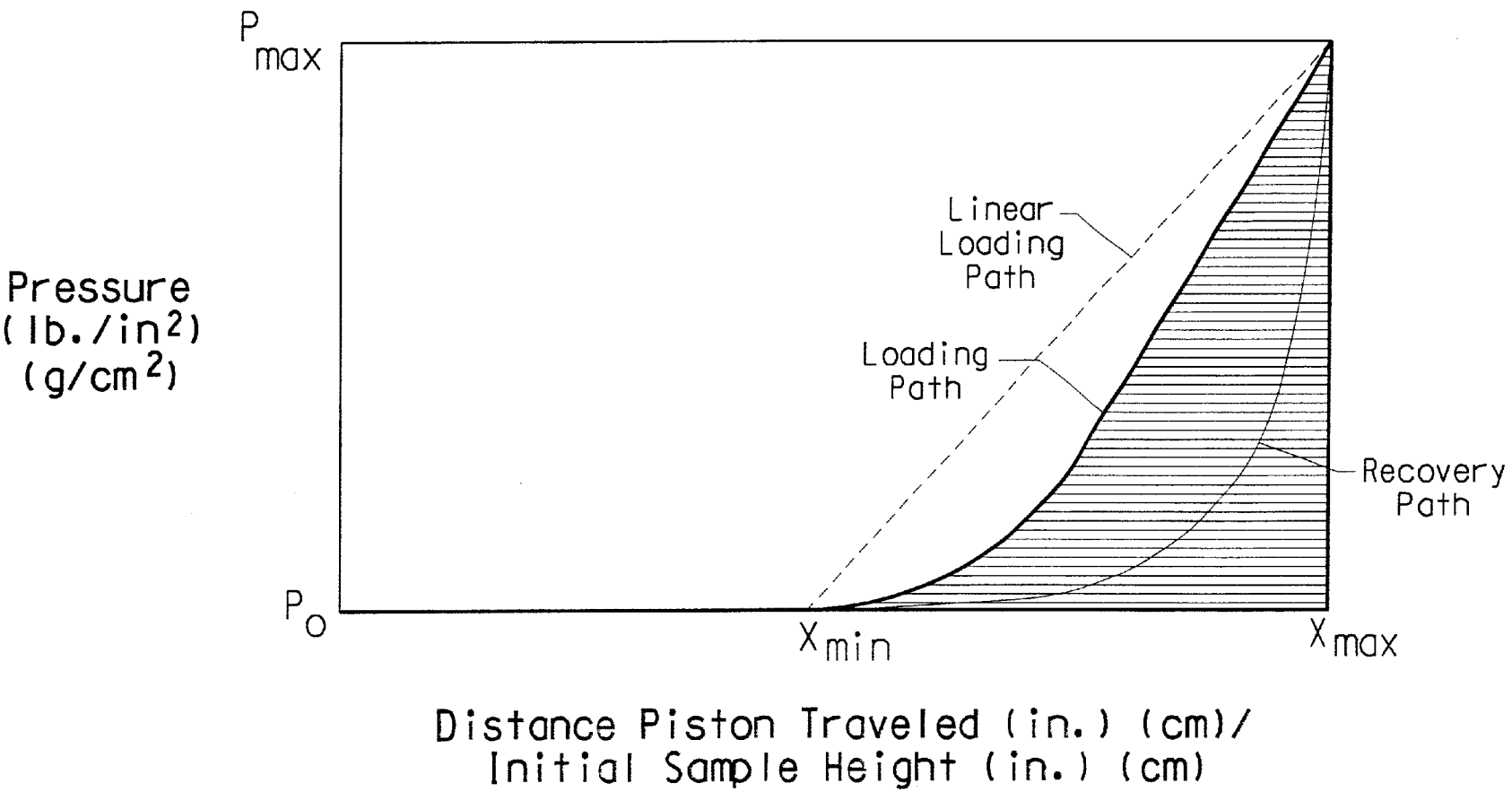
FIG. 7 is a graphical representation of WC, which is defined as the area under the loading path curve during compression, and which represents the energy required for compression.

According to the present invention, certain criteria are used for obtaining the "quality" of an article made from a corrugated fiberfill structure of the present invention, such as, a pillow or cushion, etc. Quality is defined in terms of loft/bulk, comfort, resiliency, softness, durability and insulation. These criteria include compressibility—the energy required for compression (WC), the linearity of the resulting product (LC), and the resiliency of the resulting product (RC) and which represents the ability of the structure to return to its original shape upon being compressed. Specifically, these criteria are defined as follows:

WC, compressibility, is defined as the area under the loading path as shown in FIG. 7. The area under the curve has the unit of pressure (lb/in$^2$×in/in), (or multiplied by 70.31 to convert to g/cm$^2$×cm/cm and represents energy required for compression.

Figure 8:
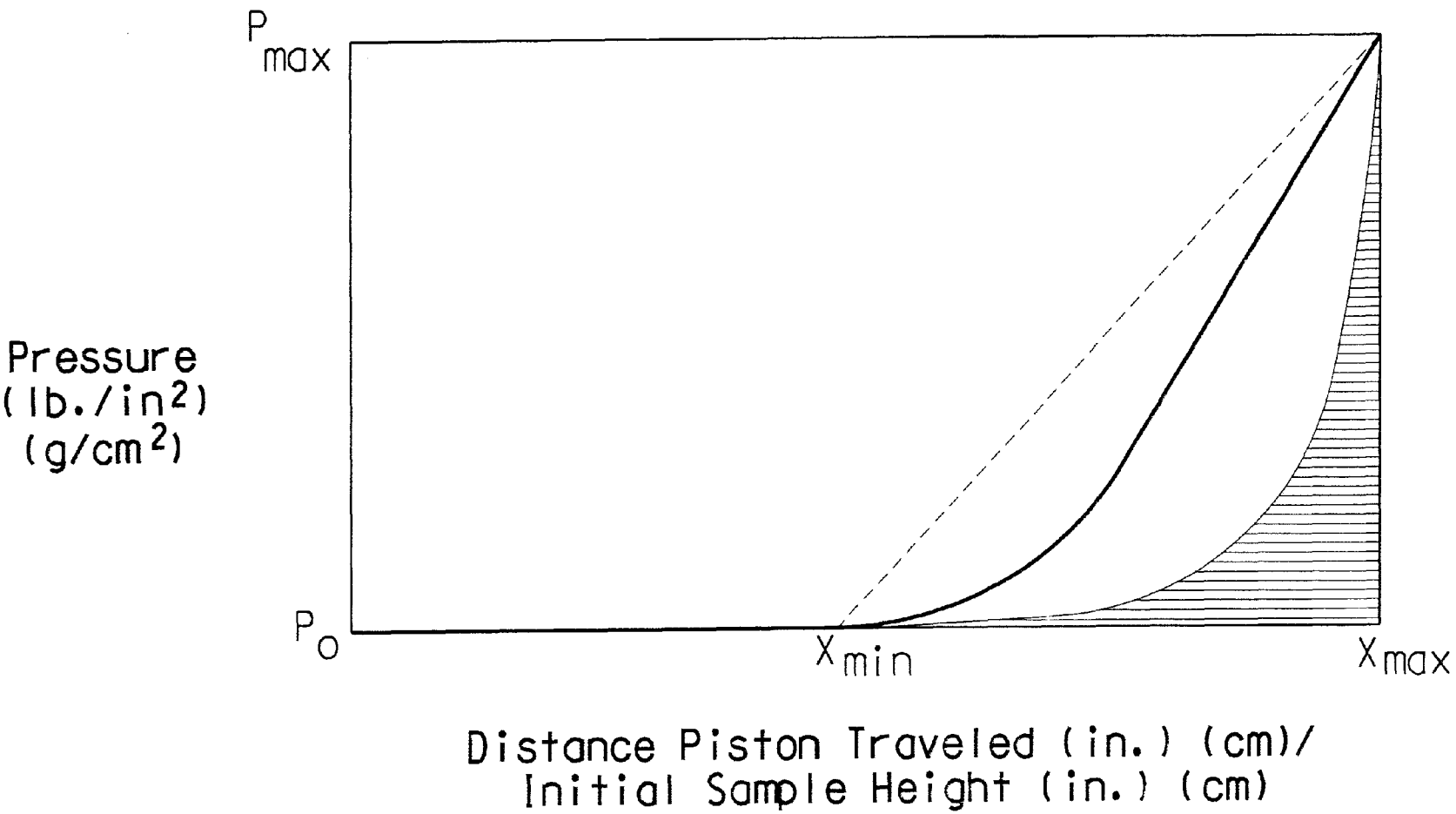
FIG. 8 is a graphical representation of WC', which is defined as the area under the recovery path curve, and which represents the recovered energy of the recovery process.

WC' is defined as the area under the recovery path as shown in FIG. 8. The area under the curve has the unit of pressure (lb/in$^2$×in/in) (or multiplied by 70.31 to convert to g/cm$^2$×cm/cm ), and represents the recovering energy given by the pressure of the recovery process.

Figure 9:
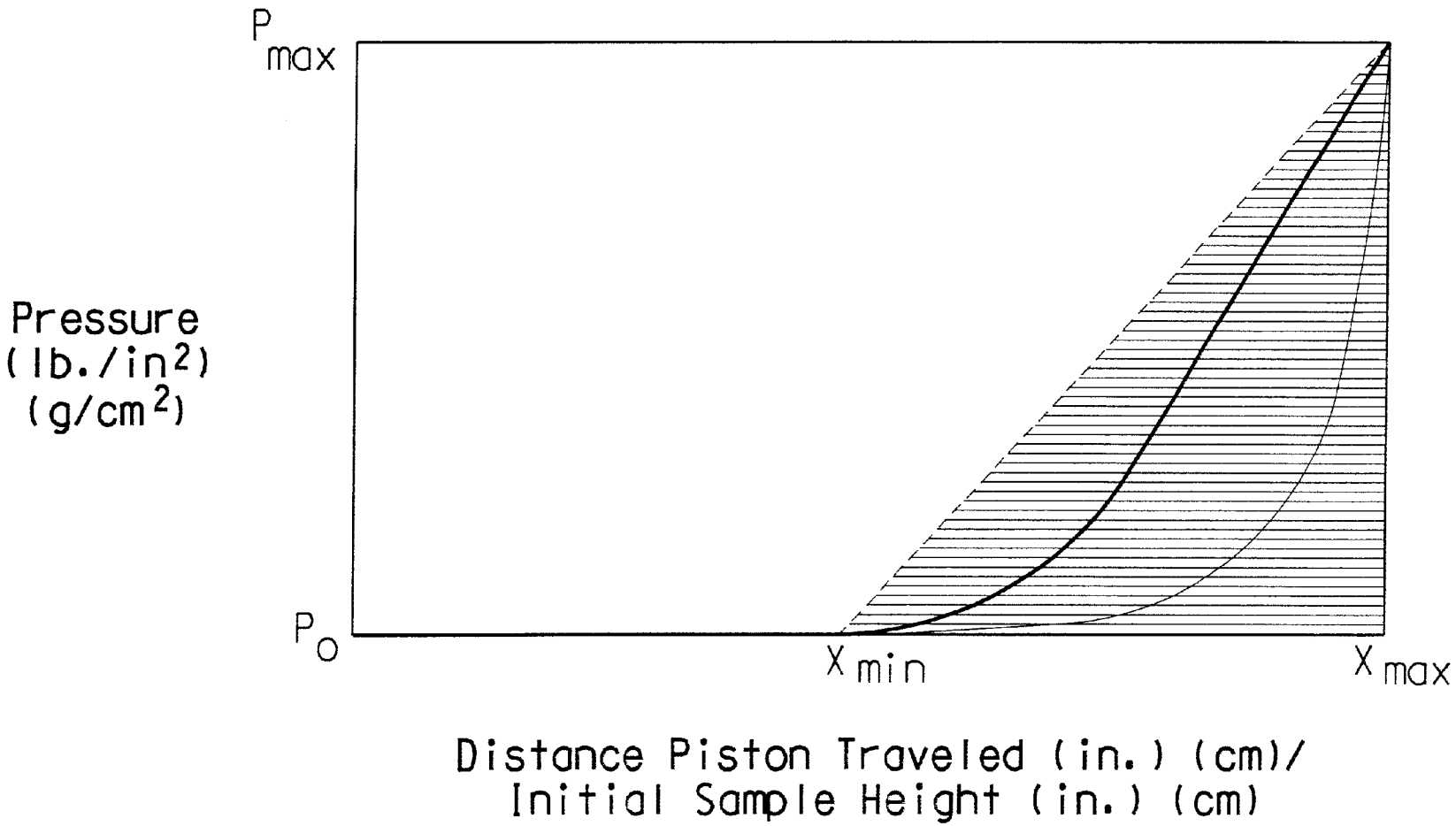
FIG. 9 is a graphical representation of WOC, which is defined as the area under the linear loading path, and which represents the energy required for compression for a linear material.

WOC is defined as the area under the linear loading path as shown in FIG. 9. The area under the curve has the unit of pressure (lb/in$^2$×in/in), (or multiplied by 70.31 to convert to g/cm$^2$×cm/cm ) and represents the energy required for a linear material.

RC is termed resilience and represents the energy loss due to compressional hysteresis and represents the ability to return to the original shape on being compressed; it is defined to be WC'/WC.

LC is termed linearity and is the linearity of sample stress versus compressive strain curve; it is defined to be WC/WOC.

Mathematical representation of the terms:

$$WC = \int_{x_{min}}^{x_{max}} P_{loading}\, dx \quad \text{(lb./in.}^2 * \text{in./in.) (or multiplied by 70.31 to convert to g/cm}^2 \times \text{cm/cm} \quad (1)$$

-continued $$WC' = \int_{x_{min}}^{x_{max}} P_{recovery}\, dx \quad \text{(lb./in.}^2 * \text{in./in.) (or multiplied by 70.31 to convert to g/cm}^2 \times \text{cm/cm)} \quad (2)$$

$$WOC = \int_{x_{min}}^{x_{max}} P_{linear}\, dx \quad \text{(lb./in.}^2 * \text{in./in.) (or multiplied by 70.31 to convert to g/cm}^2 \times \text{cm/cm)} \quad (3)$$

$$RC = \frac{WC'}{WC} \quad \text{(no unit)} \quad (4)$$

$$LC = \frac{WC}{WOC} \quad \text{(no unit)} \quad (5)$$

Applicant has found that there is a correlation between the desired structure properties of bulk density, height and peak frequency and the quality of the resulting product, as defined by WC, LC and RC. Note that it is desired to obtain a value for the energy required for compression (WC) to be as small as possible in order to have a more comfortable pillow performance. In addition, Applicant has found that there is a correlation between the fiber chosen to make the corrugated structure of the present invention, the structure properties of bulk density, height and peak frequency, and WC, LC and RC.

TEST METHODS

WC, LC and RC were measured as follows. Pillows were compressed on an Instron machine model 1123, commercially available from the Instron Corporation of Canton, Mass., with a circular compression plate of 4" (10.16 cm) diameter. The pillow was placed on a platform of the Instron machine. The platform is provided with a load cell to record the load generated during compression. When the plate touches the pillow (measured as zero distance), the load cell begins to record the load. The displacement of the plate, traveling at a velocity of 10 in/min (25.4 cm/min) was measured from zero distance to 80% of the initial height of the pillow. The stress, i.e., pressure as lb/in$^2$, (or multiplied by 70.31 to convert to g/cm$^2$ was plotted against the compressive strain, i.e., $\Delta x/x_{initial}$ (piston displacement divided by initial sample thickness). As the piston of the Instron machine moved down both stress and strain increased. As the piston reached maximum displacement, $X_{max}$, with the corresponding maximum pressure $P_{max}$, determined by the preset compression ratio, it reversed direction and travelled at the same speed, and the applied stress gradually decreased to zero.

Crimp frequency was measured by removing ten filaments from a tow bundle at random and positioned (one at a time) in a relaxed state in clamps of a fiber-length-measuring device. The clamps were manually operated and initially moved close enough together to prevent stretching of the fiber while placing it in the clamp. One end of a fiber was placed in the left clamp and the other end in the right clamp of the measuring device. The left clamp was rotated to remove any twist in the fiber. The right clamp support was moved slowly and gently to the right (extending the fiber) until all the slack has been removed from the fiber but without removing any crimp. Using a lighted magnifier, the number of peaks and the number of valleys of the fiber were counted. The right clamp support was then moved slowly to the right until all the crimp had just disappeared. Care was taken not to stretch the fiber. This length of the fiber was recorded. The crimp frequency (cpi, the metric equivalent being cpcm) for each filament was calculated as:

$$\frac{\text{Total Number of Nodes of peak and valley}}{2\times\text{Length of Filament (uncrimped)}}$$

The average of the ten measurements of all ten fibers was recorded for the cpi or cpcm.

CTU (crimp take-up) was also measured on tow and is a measure of the length of the tow extended, so as to remove the crimp, divided by the unextended length (i.e., as crimped), expressed as a percentage, as described in Anderson, et. al. U.S. Pat. No. 5,219,582.

EXAMPLES

Table 1 provides examples of properties of the fiber to be used for manufacturing the polyester fiberfill corrugated structures of the present invention together with examples of properties of the fiberfill corrugated structures to be obtained, depending on the article to be manufactured and the aesthetic value desired. Three levels of quality for the corrugated fiberfill structures of the present invention are presented in Table 1 and have values defined as "preferred" values, "more preferred" values, and "most preferred" values. These values have been determined by extensive testing.

The "preferred", "more preferred" and "most preferred" values for manufacturing the corrugated fiberfill structures of the present invention have been determined by performing numerous tests, and are tabulated in Table 1 as follows. Neural net models were used to correlate the relationship between the subjective ratings ("preferred", "more preferred", and "most preferred") and WC, LC, and RC.

TABLE 1

CORRUGATED FIBERFILL STRUCTURE PROPERTIES FOR MANUFACTURING PILLOWS

| | PREFERRED VALUES | MORE PREFERRED VALUES | MOST PREFERRED VALUES |
|---|---|---|---|
| DENIER PER FILAMENT | 10–30 | 6–10 | 0.5–6 |
| (decitex per filament) | (11.1–33) | (6.6 –11.1) | (.55 –6.6) |
| CRIMPS PER INCH | 9–10 | 10–11 | 5–10 |
| (crimps/cm) | (3.54–3.94) | (3.94–4.33) | (1.97–3.94) |
| CRIMP TAKE-UP (%) | 31–33 | 32–33 | 31–37 |
| PEAK FREQUENCY PER INCH | 9–11 | 5–10 | 8–10 |
| (peak frequency per cm) | (3.54–4.33) | (1.97–3.94) | (3.15–3.94) |
| BULK DENSITY $kg/m^3$ | 12–18 | 13–16 | 5–16 |
| STRUCTURE HEIGHT mm | 22–23 | 22–24 | 18–27 |
| PILLOW WEIGHT ounces | 20 | 20 | 20 |
| (gm) | (567) | (567) | (567) |
| PILLOW HEIGHT inches | 8–10 | 8–10 | 8–10 |
| (cm) | (20.32–25.4) | (20.32–25.4) | (20.32–25.4) |

Tables 2–4 provide the results of numerous tests performed on the pillows made from the polyester fiberfill corrugated structures of the present invention.

TABLE 2

CRITERIA FOR PILLOW RANKING PREFERRED PILLOWS

| COMPRESSION/ RECOVERY PARAMETERS | LOWER RANGE | UPPER RANGE |
|---|---|---|
| WC | | |
| $\frac{lb.*in.}{in.^2*in.}$ | .367 | .584 |
| $\frac{(gm.*cm)}{(cm.^2*cm)}$ | (25.80) | (41.06) |
| LC | .480 | .539 |
| RC | .540 | .639 |

TABLE 3

CRITERIA FOR PILLOW RANKING MORE PREFERRED PILLOWS

| COMPRESSION/ RECOVERY PARAMETERS | LOWER RANGE | UPPER RANGE |
|---|---|---|
| WC | | |
| $\frac{lb.*in.}{in.^2*in.}$ | .315 | .371 |
| $\frac{(gm.*cm)}{(cm.^2*cm)}$ | (22.15) | (26.08) |
| LC | .483 | .610 |
| RC | .544 | .563 |

TABLE 4

CRITERIA FOR PILLOW RANKING MOST PREFERRED PILLOWS

| COMPRESSION/ RECOVERY PARAMETERS | LOWER RANGE | UPPER RANGE |
|---|---|---|
| WC | | |
| $\frac{lb.*in.}{in.^2*in.}$ | .253 | .303 |
| $\frac{(gm.*cm)}{(cm.^2*cm)}$ | (17.79) | (21.30) |
| LC | .626 | .678 |
| RC | .448 | .553 |

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A corrugated fiberfill having a configuration of essentially lengthwise rectangular cross section, with continuous parallel alternating peaks and valleys of approximately equal spacing, and a plurality of generally vertically aligned pleats which extend between each peak and each valley, wherein said structure has a bulk density of about 5 to about 18 $kg/m^3$, a height of about 10 mm to about 50 mm, and wherein the peak frequency occurs at about 4 to about 15 times per inch (1.58–5.91 times per cm).

2. The corrugated structure of claim 1, wherein the corrugated structure is made of fibers with a denier per filament of about 0.5 to about 30 (0.55–33 decitex per filament), crimps per inch of about 4 to about 15, (1.58–5.91 crimps per cm) and a crimp take-up of about 29% to about 40%.

3. A pillow comprising polyester fiberfill having the corrugated structure of claim 1 or 2.

4. The pillow of claim 3, wherein the pillow has an energy for compression in the range of 0.253–0.584 $lb/in^2 \times in/in$, (17.79–41.06 $g/cm^2 \times cm/cm$), linearity in the range of 0.480–0.678 and a resiliency in the range of 0.448–0.639.

5. The pillow of claim 4, wherein the pillow has an energy for compression in the range of 0.253–0.303 $lb/in^2 \times in/in$, (17.79–21.30 $g/cm^2 \times cm/cm$), a linearity in the range of 0.626–0.678 and a resiliency in the range of 0.448–0.553.

6. A process for forming a corrugated fiberfill structure comprising:

feeding clumps of fiber stock from a bale comprising fiberfill material and a binder fiber to a picker where the fiberfill and the binder fiber are opened up;

feeding the opened up fiberfill and the binder fiber to a blender to form a uniform mixture;

carding the blend to form a fibrous web;

vertically folding the fibrous web to form a closely packed, corrugated fiberfill structure having a configuration of essentially lengthwise rectangular cross-section having continuous alternating peaks and valleys of approximately equal spacing, and a plurality of vertically aligned pleats which extend between each peak and valley; and heating the corrugated fiberfill structure to bond the binder fibers and the fiberfill material so that the structure is consolidated and maintains its corrugations, wherein the structure has a bulk density of about 5 to about 18 $kg/m^3$, a height of about 10 mm to about 50 mm and a peak frequency which occurs at about 4 to about 15 times per inch (1.58–5.91 times per cm).

7. The process of claim 6, wherein the structure comprises fibers having a denier per filament of about 0.5 to about 30 (0.55–33 decitex per filament), crimps per inch of about 4 to about 15 (1.58–5.91 crimps per cm), and a crimp take-up of about 29% to about 40%.

8. The process according to claim 6, wherein said step of vertically folding the fibrous web comprises reciprocating at least one reciprocating element perpendicular to the lengthwise direction of the fibrous web and reciprocating at least one reciprocating element parallel to the lengthwise direction of the fibrous web.

9. The process of claim 7, further comprising the steps of:

rolling the corrugated fiberfill structure; and stuffing said rolled corrugated fiberfill structure into a tick to form a pillow.

10. The pillow of claim 9, wherein the pillow has an energy for compression in the range of 0.253–0.584 $lb/in^2 \times in/in$, (17.79–41.06 $g/cm^2 \times cm/cm$), linearity in the range of 0.480–0.678 and a resiliency in the range of 0.448–0.639.

11. The pillow of claim 10, wherein the pillow has an energy for compression in the range of 0.253–0.303 $lb/in^2 \times in/in$, (17.79–21.30 $g/cm^2 \times cm/cm$), a linearity in the range of 0.626–0.678 and a resiliency in the range of 0.448–0.553.

* * * * *